United States Patent [19]

Moe et al.

[11] 3,944,173

[45] Mar. 16, 1976

[54] RAILROAD CROSSING MOTION SENSING SYSTEM

[75] Inventors: James E. Moe, Upland; Richard V. Peel, Diamond Bar; Richard E. Smith, Ontario, all of Calif.

[73] Assignee: Saftran System Corporation, Louisville, Ky.

[22] Filed: Apr. 17, 1975

[21] Appl. No.: 569,302

[52] U.S. Cl. ..... 246/34 CT; 246/128

[51] Int. Cl.[2] ..... B61L 21/06

[58] Field of Search.. 246/28 R, 28 C, 34 R, 34 CT, 246/125, 128, 129, 130

[56] References Cited

UNITED STATES PATENTS

| | | | |
|---|---|---|---|
| 3,390,256 | 6/1968 | Clanton | 246/28 R |
| 3,777,139 | 12/1973 | Peel | 246/125 |
| 3,850,390 | 11/1974 | Geiger | 246/34 CT |

*Primary Examiner*—Trygve M. Blix
*Assistant Examiner*—Reinhard J. Eisenzopf
*Attorney, Agent, or Firm*—Kinzer, Plyer, Dorn & McEachran

[57] ABSTRACT

An apparatus for detecting an approaching train within a track section utilizes a transmitter coupled to the rails at a feed point for applying a current to the track section. There is a receiver coupled to the track section for producing a signal representative of the impedance of the track section. There are devices for utilizing the received signal for detecting train motion, abnormally low impedance and abnormally high impedance of the track section. A normalizer circuit is connected to the receiver for increasing or decreasing the received signal gain within predetermined limits in accordance with variation in impedance of the track section.

24 Claims, 9 Drawing Figures

AC CURRENT ENVELOPE

PERTURBATION IN RECEIVER

DIFFERENTIATOR OUT

INTEGRATOR OUT

RAILROAD CROSSING MOTION SENSING SYSTEM

SUMMARY OF THE INVENTION

The present invention relates to a motion sensing system for railroad crossings and in particular to a system which compensates for variations in ballast resistance and receiver interference.

A primary purpose of the invention is a motion sensor of the type described including a normalizer circuit which is effective to vary the detected distance voltage in accordance with range and weather conditions.

Another purpose is a motion sensor of the type described which utilizes a normalized distance voltage in conventional high and low signal detector circuits.

Another purpose is a motion sensor system including a unique normalizing circuit in combination with a motion decisioner which compensates for electrical noise in the receiver.

Another purpose is a motion sensing system of the type described utilizing an improved track-occupied detector.

Another purpose is a motion sensing system of the type described utilizing an integrator circuit to reduce electrical interference in the detection system.

Another purpose is a motion sensor system using, in combination, a normalized distance voltage, a unique motion decisioner which compensates for receiver electrical noise and a track-occupied detector which controls the normalizer and is in part activated by the motion decisioner.

Other purposes will appear in the ensuing specification, drawings and claims.

BRIEF DESCRIPTION OF THE DRAWINGS

The invention is illustrated diagrammatically in the following drawings wherein.

FIGS. *5a–5d* are wave diagrams for various points in the motion decisioner circuit.

DESCRIPTION OF THE PREFERRED EMBODIMENT

The present invention provides certain distinct improvements on the motion sensor system shown in U.S. Pat. No. 3,777,139. Certain of the circuits of that patent are incorporated by reference into the present application and will not be described in detail.

Figure 1:
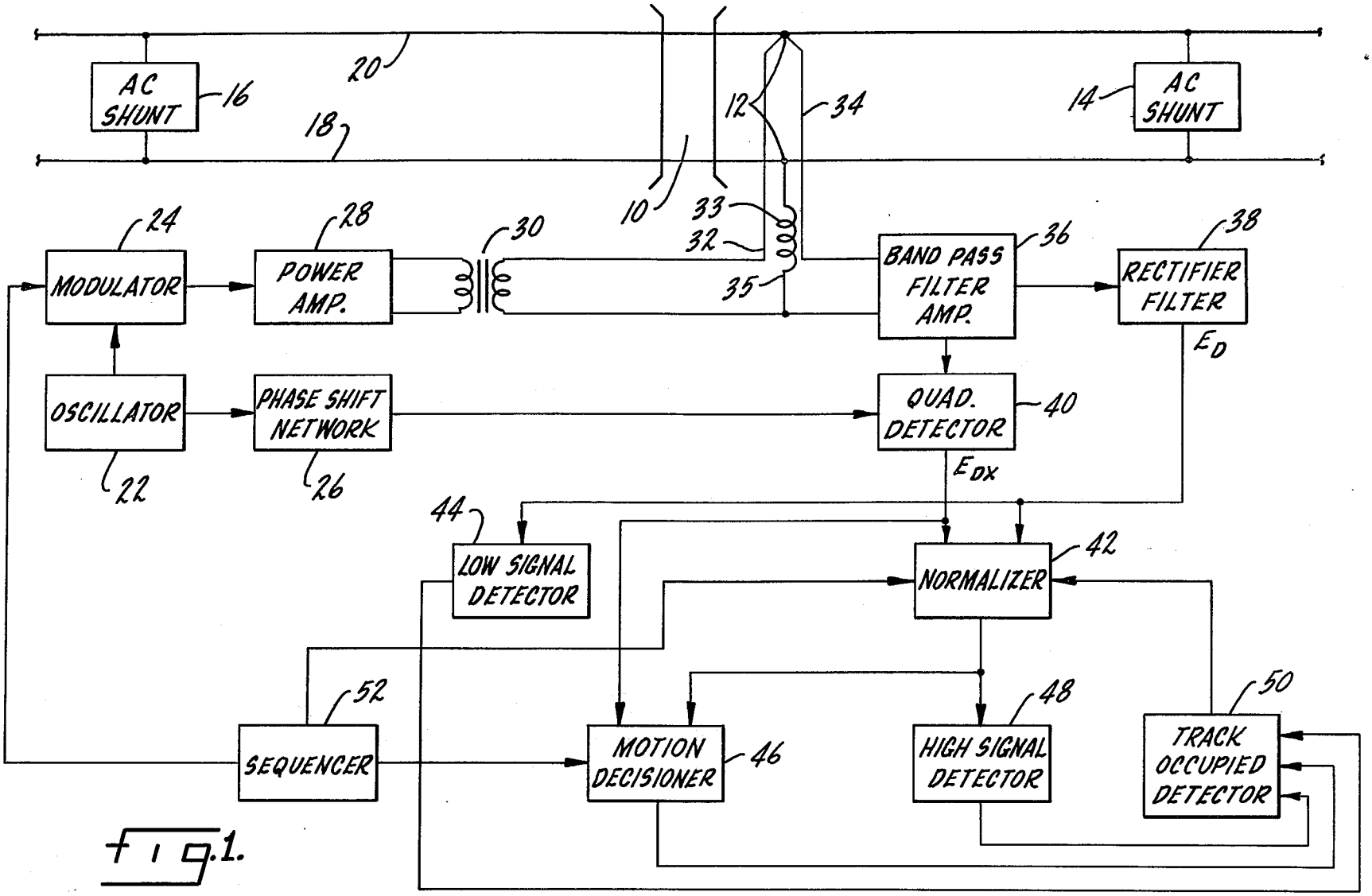
FIG. 1 is a diagram of the motion sensor system.

Looking particularly at FIG. 1, a railroad crossing is indicated at 10 and the system described herein is designed to activate crossing protection equipment such as gates and/or signals, depending upon the location of the crossing. The system will activate the crossing protection equipment whenever a train is within the section of track being monitored and is approaching the crossing at a speed greater than a predetermined minimum speed or when there is a malfunction in the system as described herein.

As is known in the art, the approach length of track becomes an integral part of the sensor system and this length is established as a function of maximum train speed, minimum warning time and the system's response time so that the crossing gates and/or signals are operated in sufficient time to provide adequate protection and warning.

In FIG. 1 the transmitter feed point 12 is adjacent the crossing 10 and there are approach distances on each side of the feed point 12. The right-hand approach is determined by the position of an AC shunt 14 and the left-hand approach is determined by the position of an AC shunt 16. The approach distances may be the same or they may be different, depending upon the particular utilization of the track in question. The shunts 14 and 16 are connected between rails 18 and 20 and, in like manner, the feed point 12 is connected to both rails 18 and 20.

The shunts 14 and 16, which are coupled between rails 18 and 20, may be a hard wire connection, a wide band AC device, such as a capacitor, or a narrow band AC device such as a sharply tuned resonant circuit. The particular type of shunt will depend upon what other signals are being transmitted through the rails.

The operation of the motion sensor system is based upon a change in impedance of the track as an approaching train shunts the rails 18 and 20. Such a shunt shortens the effective length of the track section being measured and thus reduces impedance. The motion sensor system will respond to the approaching motion of a train to activate the crossing equipment if the train speed is above a predetermined minimum. The system will be deactivated if the train stops while it is in the approach section or its speed is reduced below the minimum required for a crossing operation. At such time as the train resumes forward motion, the protection equipment will again be operated.

An oscillator 22 which will provide a signal at a selected frequency, for example in the range of 26–645 Hz, is connected to a modulator 24 and to a phase shifting network 26. A power amplifier 28 is connected to modulator 24 and provides a constant current signal to a transformer 30, the transformer being connected by lines 35 and 32 to rails 18 and 20, respectively. A coil 33 is connected in line 35 to simulate a 50-foot length of track so that the detected signal level does not disappear when a train shunt is at feed point 12. The connection between the transmitting section and the receiver section is a three-wire connection and includes wire 34. A three-wire connection assures separation of the transmitter and receiver in the event of a feed wire break and reduces the effect of feed wire series resistance and inductance.

Transformer 30 is also connected to a bandpass filter and amplifier 36 which in turn is connected to a rectifier filter 38. The phase shifting network 26 is connected to a quadrature detector 40 which also receives an input from the bandpass filter amplifier 36. As described in U.S. Pat. No. 3,777,139, the output of the rectifier filter 38 is a distance voltage $E_D$ which is applied to the various detection circuits hereinafter described. Since a constant current signal is applied to the rails, and assuming no train within either approach section, $E_D$ will be constant as long as there is no change in the impedance of the approach section. A decrease in $E_D$ normally signifies motion within the approach section of track.

The output of the quadrature detector 40 is a voltage $E_{DX}$ which is representative of the reactance component of the detected voltage. This voltage is derived in the manner shown in U.S. Pat. No. 3,614,418.

The distance voltage $E_D$ is connected to a normalizer 42 and to a low signal detector 44, the details of which are shown in the above-mentioned U.S. Pat. No. 3,777,139. The reactance component of the distance voltage, $E_{DX}$, is connected to normalizer 42 and to a motion decisioner 46. A high signal detector is indicated at 48 and receives its input from normalizer 42. High signal detector 48 is described in U.S. Pat. No. 3,777,139. The output of the high signal detector 48 and the output of the motion decisioner 46 are both connected to a track-occupied detector 50 whose output is connected to normalizer 42. A third input for the track-occupied detector 50 is provided by low signal detector 44. The overall circuit of FIG. 1 is completed by a sequencing circuit 52 having outputs connected to modulator 24, normalizer 42 and motion decisioner 46. The sequencer 52 provides timing signals for the various detection circuits and for the modulator 24, as will appear hereinafter.

In addition to the above-described basic circuits, there may be other safegaurds in the operation of the motion sensor. Since the present invention is particularly concerned with three aspects of the motion sensor, other basic circuitry, old in the art, will not be described in detail. However, it should be understood that such circuits will normally be included in the commercial embodiment of the invention.

A broken rail or rail bond causes the track impedance to increase, thereby increasing the value of $E_D$. The high signal detector circuit 48 senses this increase and activates the crossing protection in response to such an increase. In like manner, if ballast resistance (rail-to-rail leakage resistance) decreases, the value of $E_D$ decreases. At some low ballast resistance the ability to detect a broken rail or rail bond is compromised. Hence, the low signal detector 44 monitors $E_D$ and if this voltage falls below a critical value, and a set of logic tests (track-occupied detector 50) indicate that no train is in the approach track section, the low signal detector activates the crossing protection.

Figure 2:
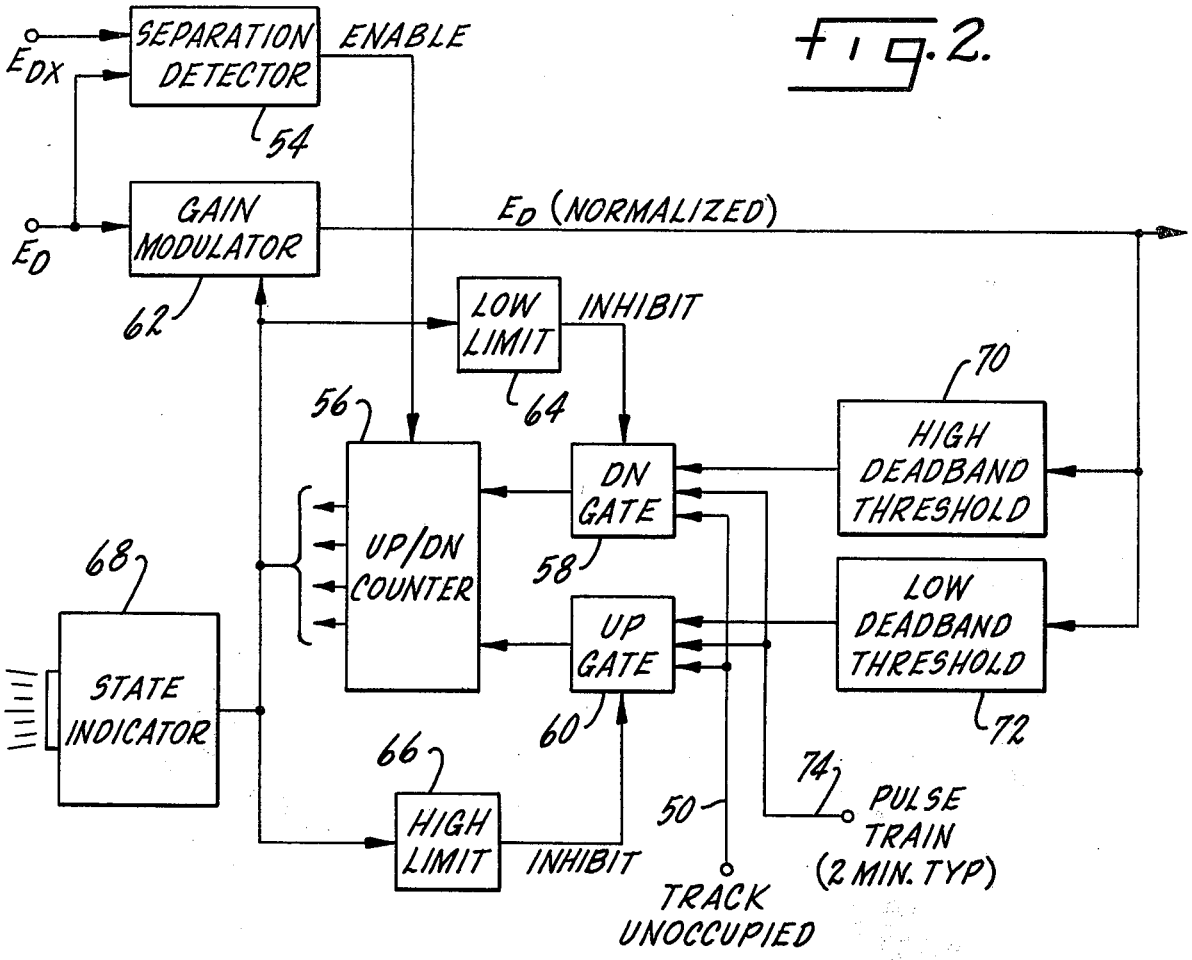
FIG. 2 is a block diagram of the normalizer circuit.

Ballast resistance typically reduces in wet weather. Also, the greater the approach track distance, the more pronounced is the $E_D$ voltage sag. Thus, the need for broken rail detection imposes range and weather performance limits on the system. To extend these limits, an $E_D$ normalizer is employed and is shown in detail in FIG. 2. The normalizer includes a separation detector 54 having inputs of $E_D$ and $E_{DX}$. If the separation of the two input voltages to the separation detector, $E_D$ and $e_{DX}$, is greater than a preset value, indicating that the limit of broken rail detection is being approached, the normalizer circuit is enabled. Typically, the phase detected voltage $E_{DX}$ will sag more readily with deteriorating ballast resistance than $E_D$. The output of detector 54 is connected to an up-down counter 56 which has inputs from a down gate 58 and an up gate 60. The output from counter 56 is connected to a gain modulator 62. Also connected to the output of counter 56 is a low limit gate 64 which is connected to place an inhibit on down gate 58 and a high limit inhibit circuit 66 which is connected to place an inhibit signal on up gate 60. A state indicator is indicated at 68 and is connected to the counter 56 in such a manner as to give a visual indication of the position of the counter. A high deadband threshold circuit 70 and a low deadband threshold circuit 72 each receive a normalized $E_D$ input and have their outputs connected to, respectively, down gate 58 and up gate 60.

Looking at FIG. 3, which illustrates the relationship between $E_D$ and distance from the feed point to the terminal shunt point, curve A represents low ballast resistance, below which the system is unable to effectively detect a broken rail. Curve B represents high ballast resistance or normal ballast resistance. The normalizer circuit is effective to maintain $E_D$ between the high signal point C and the low signal point D. When $E_D$ is above point C, there is an indication of a broken rail or broken rail bond and the high signal detector will be activated in the manner described in U.S. Pat. No. 3,777,139. Taking into consideration range and weather conditions, the normalizer maintains $E_D$ as close as possible to normal signal level E. Thus, the normalizer overcomes any effects on $E_D$ caused by weather or distance and maintains $E_D$ in a predetermined range, providing there is no broken rail, excessively deteriorating ballast resistance or motion detected within the approach section.

When there is sufficient separation between $E_D$ and $E_{DX}$, which is detected by the separation detector 54, an enable signal is provided to up-down counter 56. Both the up gate and the down gate 58 and 60, respectively, are operated at predetermined intervals so that the long term change in ballast resistance effects the system, not any short period changes. Thus, a pulse train of two minutes' pulse separation is indicated at 74 and will be used to activate both the up and down gates. In like manner, a signal from track-occupied detector 50 is applied to the up and down gates so that the gates will not be activated at such time as motion is detected within the approach section. Thus, assuming an activating pulse from source 74 and no inhibit signal from either the low limit or high limit circuits 64 and 66, and that the up-down counter has been activated by the enabling circuit 54, if either the high deadband threshold or the low deadband threshold, as shown in FIG. 3, have been exceeded, then either an up pulse or a down pulse will be provided by the appropriate gate to counter 56. Counter 56 is a four-bit up-down counter and hence there are 15 steps which are available from the zero condition. At the fifteenth step gain modulator 62 has added all of the gain available (typically 3DB). A subsequent reduction in $E_D$ will activate the low signal detector, assuming that no train has been detected in the apprach section.

Figure 3:
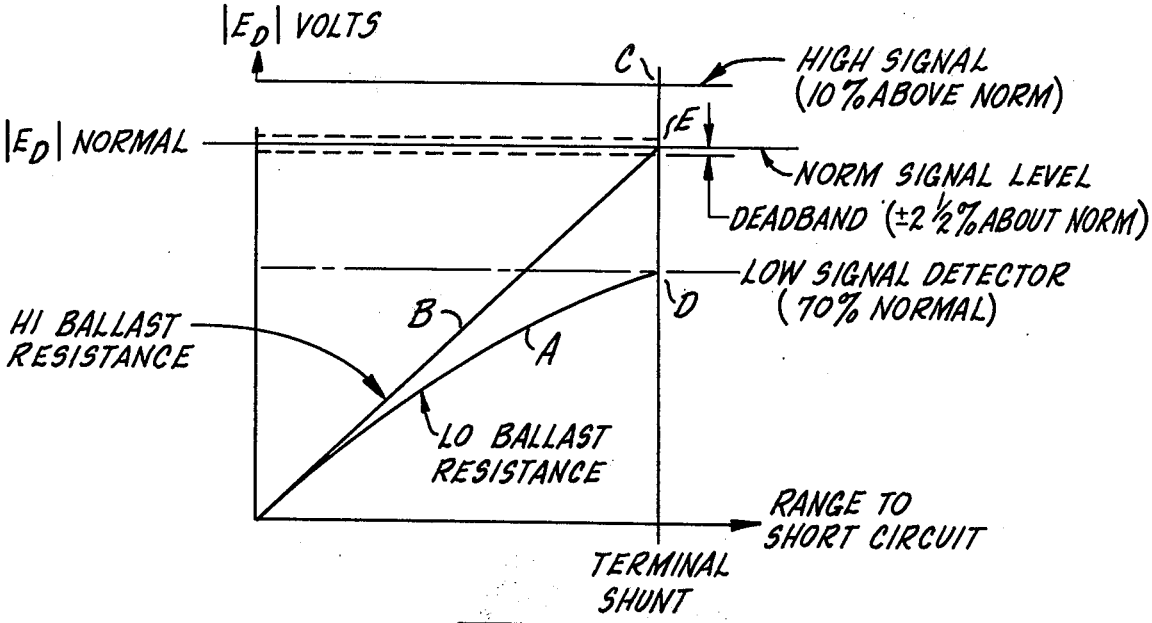
FIG. 3 is a wave form diagram of distance voltage vs. distance.
Figure 4:
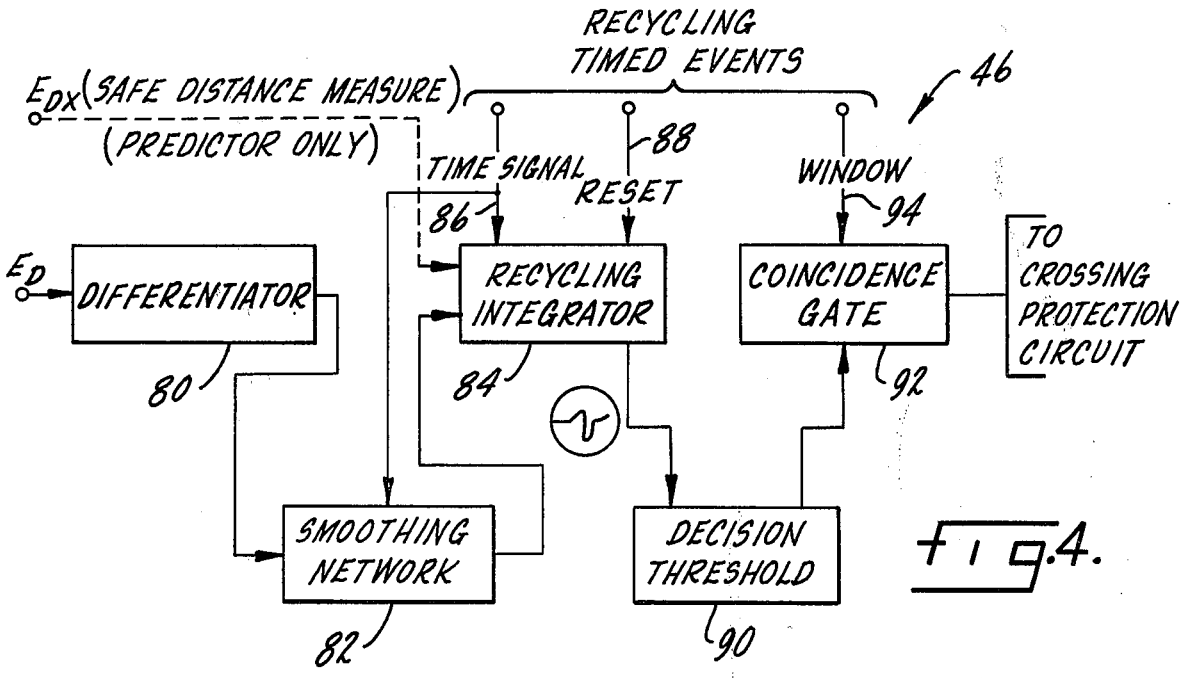
FIG. 4 is a block diagram of the motion decisioner.

There is a dead band of about plus or minus 2½ percent about the normal signal level E as shown in FIG. 3. Upon the high deadband threshold, 2½ percent above normal, being exceeded and assuming a signal from source 74 and an indication that no train is in the approach section, the down gate will provide a signal to the up-down counter 56. If the counter is enabled by the separation detector, the gate modulator will provide an $E_D$ output reduced a predetermined amount to return $E_D$ within the dead band of plus or minus 2½ percent about the normal signal level. Thus, the normalizer tends to follow changes in ballast resistance caused by weather and range conditions. The $E_D$ output, useful in the high and low signal detectors, will not cause the crossing protection equipment to be activated unless there is in fact a broken rail or broken rail bond or ballast resistance has truly decreased to the point where such a condition can no longer be recognized. The normalizer maintains the detected $E_D$ voltage within predetermined limits and takes into account any changes in ballast resistance due to weather and range conditions.

Sequencer 52 is connected to modulator 24 and to motion decisioner 46. The motion decisioner 46 includes a differentiator 80 which receives a normalized $E_D$ input. The differentiator output is filtered in a smoothing network 82 which has its output connected to a recycling integrator 84. The integrator 84 also receives an $E_{DX}$ input when the system is used with a grade crossing predictor. Such an input is not necessary with a motion sensing system. The smoothing network 82 is positioned between the differentiator 80 and integrator 84 so that in high interference situations variability of the integrator output can be kept at a value low enough to preclude false motion alarms. Filter time constants, typically 2–6 seconds, can be selected for the smoothing network. A fraction of the filter time constant becomes blind time that must expire before motion can be seen through the motion decisioner. The filter time constant is reduced to zero and the integration rate speeded by action of the time signal on integrator input 86 from the sequencer. The time change signal coincides with passage of the dynamic self-check pulse as described hereinafter. The integrator 84 also receives a timed input 88 from the sequencer 82 and has an output connected to a decision threshold circuit 90. A coincidence gate 92 receives one input from sequencer 52, as designated at 94, and a second input from decision threshold circuit 90. The output from coincidence gate 92 is connected to the crossing protection drive circuit.

FIGS. 5a, 5b, 5c and 5d illustrate wave forms at various points in the motion decisioner.

An inherent liability of the differentiation process which provides a voltage representative of train motion is the enhancement of interference carried into the receiver. To reduce operating difficulties under electrically noisy conditions, the measuring system is operated on a recycling time frame, normally two seconds in duration. Through each frame the motion signal, differentiated, $E_D$ is smoothed, then accumulated in integrator 84 to form a single observation for the entire frame. At the end of the frame a decision is made concerning the presence or absence of train motion above a preset level. The integrator is thereupon reset preparatory to motion observation in the next frame. The result of this type of processing is a substantial reduction of interference as registered in motion decisions. In grade crossing predictor usage the phase detected distance measuring signal, $E_{DX}$ is summed with differentiated $E_D$ at the integrator. $E_{DX}$ is weighted and polarized with respect to the motion derivative such that the predictor equation is solved by the device. Further details of the predictor equation are disclosed in U.S. Pat. No. 3,614,418.

Looking particularly at FIGS. *5a–5d*, in FIG. *5a*, an amplitude perturbation is imposed on input track current and this is typically a 0.06 second perturbation in a two second time frame. The sequencer 52 provides the necessary timed control of modulator 24. The current perturbation is weighted reciprocally with the prevailing $E_D$ so that in the receiver the perturbation takes virtually constant size. See FIG. *5b*. After differentiation, FIG. *5c*, the perturbation is fed into the integrator at an essentially zero time constant rate as described above. The result is a sharp excursion in the approach motion direction. See FIG. *5d*. If motion greater than some preset value, typically 2 mph, is present the excursion will start from a value greater than the decision threshold value. No threshold crossing occurs. However, if approaching motion less than the preset value, no motion, or receding motion is present, the decision threshold is crossed within the decision time window. Thus, either proper motion or loss of the self-check perturbation due to system malfunction results in the start of crossing protection.

The threshold circuit action is observed through a narrow time window at the expected time of arrival of the self-check perturbation. If the threshold is crossed within that window, by circuit 90, then an AC voltage is gated, by gate 92, to maintain the crossing protection equipment inactive. Similarly, at each crossing in the window, a pulse is gated to implement a circuit requiring two consecutive motion observations before crossing protection is started.

Thus, the motion decisioner provides a signal to the track occupied detector 50 as controlled by the sequencer 52 providing logic information as to the absence or presence of a moving train, over a predetermined minimum speed, within the approach section of the track.

Figure 6:
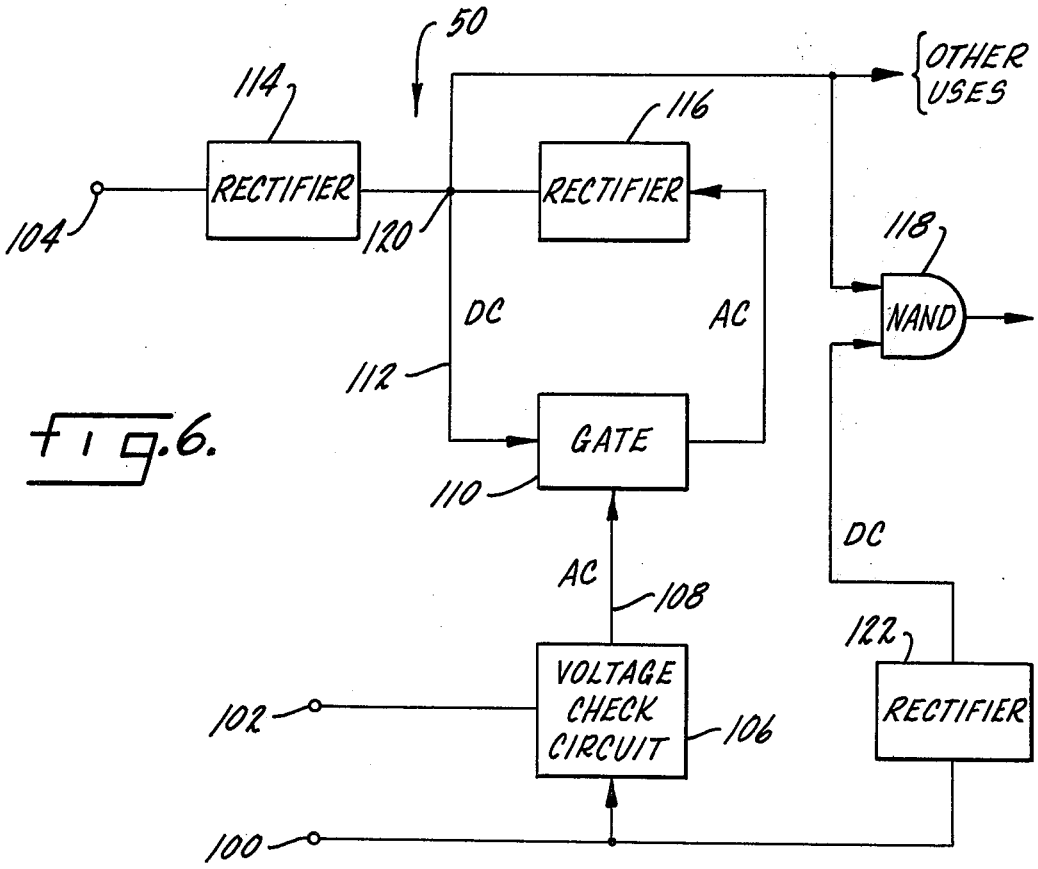
FIG. 6 is a block diagram of the track-occupied detector.
Figure 5A:
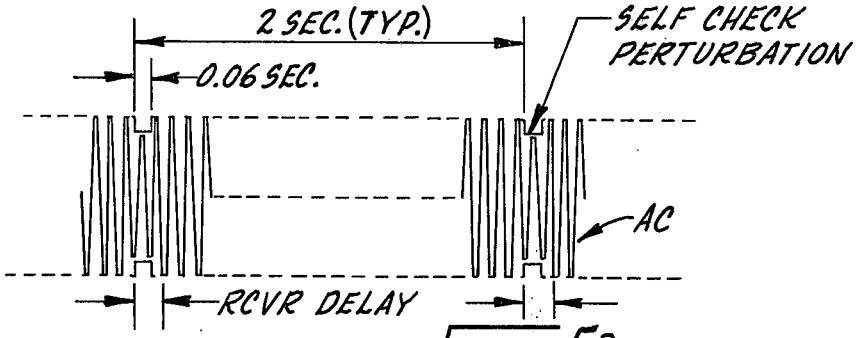
Figure 5B:
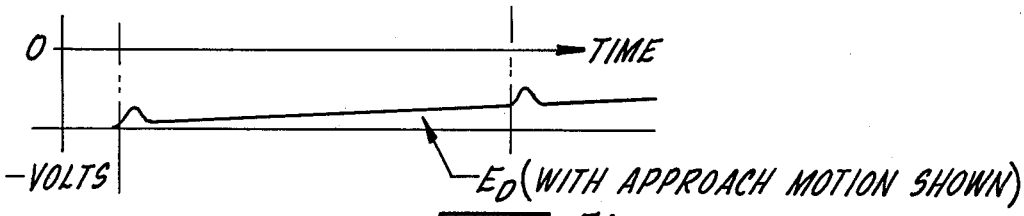
Figure 5C:
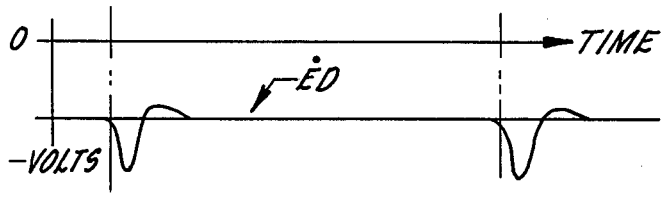
Figure 5D:
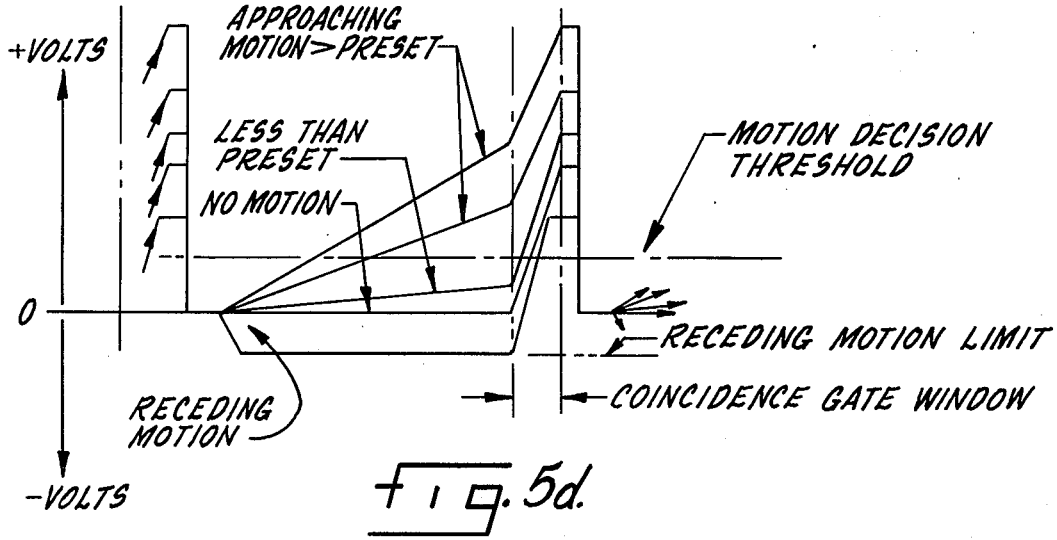

The track-occupied detector 50 is illustrated in FIG. 6 and has three inputs. A first input 100 is from high signal detector 48. A second input 102 is from motion decisioner 46 and a third input 104 is from low signal detector 44. Inputs 100 and 102 are connected to a voltage check circuit 106 which will provide an AC output on its output line 108 provided there are inputs on both lines 100 and 102 signifying that there is no motion being detected in the approach section and the high signal level has not been exceeded. Voltage check circuit 106 has its output on line 108 connected to an AC/DC AND gate 110, which also receives an input via line 112 from a rectifier 114 connected to input 104. A second rectifier 116 has an AC input from gate 110. A NAND gate 118 has one input from the junction 120 of rectifiers 114 and 116 and a second input from an inversion rectifier 122 which has an input from the high signal detector line 100. The output of the NAND gate 118 is connected to the normalizer 42 and provides outputs at two different voltage levels. One level indicating that the track is occupied and the second level indicating that the track is unoccupied.

In operation assuming there is a signal on line 100, indicating that the high signal level has not been exceeded, there will be no signal from inversion rectifier 122 at NAND gate 118. Also assuming that the motion decisioner circuit 46 provides an output indicating that there is no detected motion in the approach section, there will be a signal on input 102 to voltage check circuit 106. Thus, with signals on both inputs 100 and 102 for voltage check circuits 106, it will have an output on line 108 to gate 110. Gate 110 will latch and provide an AC output to rectifier 116 which in turn will provide a voltage at junction 120 and thus a signal to the other input of NAND gate 118. With a signal on only one input line, the output of NAND gate 118 will be a voltage indicating that the track is unoccupied.

If there is detected motion by motion decisioner 46, there will be no input to circuit 106. Thus, voltage check circuit 106 will not provide an AC input to gate 110 and there will be no voltage provided at junction 120 by gate 110 through rectifier 116. Since there is detected motion, low signal detector 44 will no longer provide a voltage at input 104 and thus rectifier 114 cannot now provide a voltage at junction 120. Thus, there will be no inputs to NAND gate 118 and so the output from this gate will be a voltage level signifying that the track is occupied and this signal will be applied to the normalizer as described above. Normally, junction 120 can receive a voltage to apply to NAND gate 118 either from gate 110 through rectifier 116, signifying no motion and that the high signal has not been exceeded, or from low signal detector 44 indicating that ballast resistance has not decreased to the point where a broken rail cannot be detected, or signifying that there is no drop in the distance voltage signifying motion within the approach section. NAND gate 118 will only provide an output signifying that the track is occupied when neither or its inputs have a signal.

In summary, the invention provides several unique circuits for use in a motion sensing system and/or a crossing predictor system. The normalizer compensates for variations in ballast resistance and range to assure that under normal conditions a broken rail can be detected.

The motion decisioner provides a means for assuring that electrical noise or interference in the system will not interfere with the normal functions of the receiver. The differentiation process followed by the integration process compensates for noise.

The track-occupied detector logic system utilizes signals from the motion decisioner and high and low signal detectors to control operation of the normalizer.

Whereas the preferred form of the invention has been shown and described herein, it should be realized that there may be many modifications, substitutions and alterations thereto.

The embodiments of the invention in which an exclusive property or privilege is claimed are defined as follows:

1. An apparatus for detecting an approaching train within a track section between a feed point and at least one low impedance connection across the rails, said apparatus including:

transmitter means coupled to the rails at the feed point for applying a current to the track section, receiver means coupled to the track section for producing a first signal representative of the impedance of said track section, means for utilizing said first signal for detecting train motion, abnormally low impedance and abnormally high impedance, The improvement comprising a normalizer circuit connected to said receiver means for increasing or decreasing said first signal within predetermined limits in accordance with variations in impedance of said track section.

2. The apparatus of claim 1 further characterized in that said normalizer circuit includes enabling means operated upon detecting a predetermined ballast condition.

3. The apparatus of claim 2 further characterized in that said receiver includes means for producing a second signal representative of the reactance component of the impedance of said track section, said enabling means including circuit means for detecting the difference between said second signal and said first signal.

4. The apparatus of claim 2 further characterized in that said normalizer circuit includes circuit means for controlling the increase or decrease of said first signal in predetermined steps.

5. The apparatus of claim 4 further characterized in that said normalizer circuit includes counting means for controlling the increase or decrease of said first signal.

6. The apparatus of claim 5 further characterized by and including a pair of gates connected to said counting means, one gate providing for an increase in said first signal, the other gate providing for a decrease, each of said gates having a plurality of inputs, a timing circuit providing one of said inputs, a detection circuit for measuring the level of said first signal providing another of said inputs.

7. An apparatus for detecting an approaching train within a track section between a feed point and at least one low impedance connection across the rails, said apparatus including:

transmitter means coupled to the rails at the feed point for applying a current to the track section, receiver means coupled to the track section for producing a first signal representative of the impedance of said track section, the improvement comprising means for changing the level of said transmitted current for a limited period of time during a predetermined time frame, differentiator means coupled to said receiver means for producing a signal representative of the rate of change of said first signal, integrator means coupled to said differentiator means, and a threshold detector connected to said integrator means for use in determining when said rate of change signal represents train motion.

8. The apparatus of claim 7 further characterized in that said threshold circuit detects, after differentiation and integration, the changed level of said transmitter current.

9. The apparatus of claim 8 further characterized by and including a gate connected to said threshold detector and timing means connected to said gate, simultaneous inputs to said gate from said timing circuit and threshold detector providing a gate output indicating no train motion.

10. The apparatus of claim 7 further characterized in that the level of said transmitted current is decreased for a limited period of time during said predetermined time frame.

11. An apparatus for detecting an approaching train within a track section between a feed point and at least one low impedance connection across the rails, said apparatus including:

transmitter means coupled to the rails at the feed point for applying a current to the track section, receiver means coupled to the track section for producing a signal representative of the impedance of said track section, normalizer means connected to said receiver means for increasing or decreasing said signal within predetermined limits in accordance with variations in impedance of said track section, motion decision means connected to said normalizer circuit for determining when said signal represents train motion, and track-occupied detector means connected to said motion decision means and having an output connected to said normalizer circuit.

12. The apparatus of claim 11 further characterized in that said normalizer circuit includes means for increasing or decreasing said signal in predetermined steps.

13. The apparatus of claim 11 further characterized in that said track-occupied detector output is connected to said normalizer circuit for disabling said normalizer circuit when train motion is detected.

14. The apparatus of claim 11 further characterized in that said motion decision circuit includes a differentiator connected to said normalizer and an integrator connected to said differentiator, the output of said integrator providing an indication of the presence or absence of detected motion.

15. The apparatus of claim 14 further characterized in that said transmitting means includes means for changing the level of transmitted current for a limited period of time during a predetermined time frame, said motion decision circuit including a threshold circuit for detecting motion based on said change in transmitted current.

16. The apparatus of claim 11 further characterized by and including low signal detector means connected to said receiver means for producing a warning signal when said signal is less than a preselected value, said track-occupied detector being connected to said low signal detector means.

17. The apparatus of claim 16 further characterized by and including a high signal detector connected to said track-occupied detector and to said normalizer circuit, said high signal detector providing an output when the impedance of said track section exceeds a predetermined value.

18. An apparatus for detecting an approaching train within a track section between a feed point and at least one low impedance connection across the rails, said apparatus including:

transmitter means coupled to the rails at the feed point for applying a current to the track section, receiver means coupled to the track section for producing a signal representative of the impedance of said track section, means for utilizing said signal for detecting train motion, abnormally low impedance and abnormally high impedance, a normalizer circuit connected to said receiver means for increasing or decreasing said signal within predetermined limits, in accordance with variations in impedance of said track section, and a track-occupied detector connected to the means for utilizing said signal for detecting train motion having its output connected to said normalizer circuit.

19. The apparatus of claim 18 further characterized in that said track-occupied detector includes means for disabling said normalizer circuit when the track section is occupied.

20. The apparatus of claim 19 further characterized by and including low signal detector means coupled to said receiver means for producing a warning signal when said signal is less than a preselected value, said low signal detector means being connected to said track-occupied detector.

21. The apparatus of claim 19 further characterized by and including high signal detector means connected to the output of said normalizer circuit and having an output connected to said track-occupied detector, said high signal detector means providing an output when impedance of said track section exceeds a preselected value.

22. An apparatus for detecting an approaching train within a track section between a feed point and at least one low impedance connection across the rails, said apparatus including:

transmitter means coupled to the rails at the feed point for applying a current to the track section, receiver means coupled to the track section for producing a first signal representative of the impedance of said track section, means for changing the level of said transmitted current for a limited period of time during a predetermined time frame, differentiator means coupled to said receiver for producing a signal representative of the rate of change of said first signal, integrator means coupled to said differentiator means, and a threshold detector connected to said integrator means for use in determining when said rate of change signal represents train motion, and a track-occupied detector connected to the output of said integrator means.

23. The apparatus of claim 22 further characterized by and including a low signal detector coupled to said receiver means for producing a warning signal when said first signal is less than a preselected value, said low signal detector being connected to said track-occupied detector.

24. The apparatus of claim 22 further characterized by and including high signal detector means connected to said receiver means for producing a signal when said first signal exceeds a preselected value, with the output of said high signal detector being connected to said track-occupied detector.

* * * * *